US008027837B2

(12) United States Patent
Silverman et al.

(10) Patent No.: US 8,027,837 B2
(45) Date of Patent: Sep. 27, 2011

(54) USING NON-SPEECH SOUNDS DURING TEXT-TO-SPEECH SYNTHESIS

(75) Inventors: Kim E. A. Silverman, Mountain View, CA (US); Matthias Neeracher, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 1238 days.

(21) Appl. No.: 11/532,470

(22) Filed: Sep. 15, 2006

(65) Prior Publication Data

US 2008/0071529 A1 Mar. 20, 2008

(51) Int. Cl.
*G10L 13/00* (2006.01)
*G10L 13/06* (2006.01)
*G10L 13/08* (2006.01)

(52) U.S. Cl. ..... 704/268; 704/260

(58) Field of Classification Search ..... 704/260, 704/268

See application file for complete search history.

(56) References Cited

U.S. PATENT DOCUMENTS

| | | | | |
|---|---|---|---|---|
| 4,278,838 | A * | 7/1981 | Antonov | 704/260 |
| 5,732,395 | A * | 3/1998 | Silverman et al. | 704/260 |
| 5,771,276 | A | 6/1998 | Wolf | |
| 5,850,629 | A * | 12/1998 | Holm et al. | 704/260 |
| 6,014,428 | A | 1/2000 | Wolf | |
| 6,047,255 | A | 4/2000 | Williamson | |
| 6,125,346 | A | 9/2000 | Nishimura et al. | |
| 6,173,263 | B1 * | 1/2001 | Conkie | 704/260 |
| 6,185,533 | B1 | 2/2001 | Holm et al. | |
| 6,513,008 | B2 | 1/2003 | Pearson et al. | |
| 6,535,852 | B2 * | 3/2003 | Eide | 704/260 |
| 6,757,653 | B2 | 6/2004 | Buth et al. | |
| 6,862,568 | B2 * | 3/2005 | Case | 704/260 |
| 6,910,007 | B2 * | 6/2005 | Stylianou et al. | 704/207 |
| 6,978,239 | B2 | 12/2005 | Chu et al. | |
| 6,990,450 | B2 | 1/2006 | Case et al. | |
| 7,035,794 | B2 | 4/2006 | Sirivara | |
| 7,191,131 | B1 | 3/2007 | Nagao | |
| 7,292,979 | B2 | 11/2007 | Karas et al. | |
| 7,472,065 | B2 * | 12/2008 | Aaron et al. | 704/258 |
| 2002/0052730 | A1 | 5/2002 | Nakao | |
| 2002/0072908 | A1 | 6/2002 | Case et al. | |
| 2002/0133348 | A1 | 9/2002 | Pearson et al. | |
| 2002/0173961 | A1 | 11/2002 | Guerra | |
| 2003/0050781 | A1 | 3/2003 | Tamura et al. | |
| 2004/0111266 | A1 | 6/2004 | Coorman et al. | |
| 2004/0254792 | A1 | 12/2004 | Busayapongchai et al. | |

(Continued)

OTHER PUBLICATIONS

Chung-Hsien Wu, Jau-Hung Chen, Automatic generation of synthesis units and prosodic information for Chinese concatenative synthesis, Speech Communication, vol. 35, Issues 3-4, Oct. 2001, pp. 219-237, ISSN 0167-6393.

*Primary Examiner* — Eric Yen
(74) *Attorney, Agent, or Firm* — Fish & Richardson P.C.

(57) ABSTRACT

Systems, apparatus, methods and computer program products are described for producing text-to-speech synthesis with non-speech sounds. In general, some of the pauses or silences that would otherwise be generated in synthesized speech are instead synthesized as non-speech sounds such as breaths. Non-speech sounds can be identified from pre-recorded speech that can include meta-data such as the grammatical and phrasal structure of words and sounds that precede and succeed non-speech sounds. A non-speech sound can be selected for use in synthesized speech based on the words, punctuation, grammatical and phrasal structure of text from which the speech is being synthesized, or other characteristics.

13 Claims, 9 Drawing Sheets

U.S. PATENT DOCUMENTS

2005/0119890 A1 6/2005 Hirose
2006/0074674 A1 4/2006 Zhang et al.
2007/0106513 A1 5/2007 Boillot et al.
2007/0192105 A1 8/2007 Neeracher et al.
2007/0244702 A1 10/2007 Kahn et al.
2009/0076819 A1 3/2009 Wouters et al.

* cited by examiner

USING NON-SPEECH SOUNDS DURING TEXT-TO-SPEECH SYNTHESIS

BACKGROUND

The following disclosure generally relates to information systems.

In general, conventional text-to-speech application programs produce audible speech from written text. The text can be displayed, for example, in an application program executing on a personal computer or other device. For example, a blind or sight-impaired user of a personal computer can have text from a web page read aloud from the personal computer. Other text to speech applications include those that read from a textual database and provide corresponding audio to a user by way of a communication device, such as a telephone, cellular telephone, portable music player, in-vehicle navigation system or the like.

Speech from conventional text-to-speech applications typically sounds artificial or machine-like when compared to human speech. One reason for this result is that current text-to-speech applications often synthesize momentary pauses in speech with silence. The location and length of pauses is typically determined by parsing the written text and the punctuation in the text such as commas, periods, and paragraph delimiters. However, using empty silence to synthesize pauses, as conventional synthesis applications do, can lead listeners to feel a sense of breathlessness; particularly after lengthy exposure to the results of such synthesis. In human-produced speech, pauses can actually consist of breath intakes, mouth clicks and other non-speech sounds. These non-speech sounds provide subtle clues about the sounds and words that are about to follow. These clues are missing when pauses are synthesized as silence, thus requiring more listener effort to comprehend the synthesized speech.

Some text-to-speech applications produce speech that can include emotive vocal gestures such as laughing, sobbing, crying, scoffing and grunting. However, in general such gestures do not improve comprehension of the resultant speech. Moreover, these techniques rely on explicitly annotated input text to determine where to include the vocal gestures in the speech. Such annotated text may, for example, appear as follows, "What? <laugh1> You mean to tell me this is an improvement? <laugh4>." The text '<laugh1>' is an example of a specific textual command that directs the synthesis to produce a specific associated sound (e.g., a mocking laugh).

SUMMARY

Systems, apparatus, methods and computer program products are described below for producing text-to-speech synthesis with non-speech sounds. In general, some of the pauses or silences that would otherwise be generated in synthesized speech are instead synthesized as non-speech sounds such as breaths. Non-speech sounds can be identified from pre-recorded speech that can include meta-data such as the grammatical and phrasal structure of words and sounds that precede and succeed non-speech sounds. A non-speech sound can be selected for use in synthesized speech based on the words, punctuation, grammatical and phrasal structure of text from which the speech is being synthesized, or other characteristics.

In one aspect a method is provided that includes augmenting a synthesized speech with a non-speech sound other than silence, the augmentation based on characteristics of the synthesized speech.

One or more implementations can optionally include one or more of the following features. The method can include replacing pauses in the synthesized speech with a non-speech sound. Augmenting can include identifying the non-speech sound based on punctuation, grammatical or phrasal structure of text associated with the synthesized speech. The non-speech sound can include the sound of one or more of: inhalation; exhalation; mouth clicks; lip smacks; tongue flicks; and salivation.

In another aspect a method is provided that includes identifying a non-speech unit in a received input string where the non-speech unit is not associated with a specific textual reference in the input string. The non-speech unit is matched to an audio segment, which is a voice sample of a non-speech sound. The input string is synthesized, which includes combining the audio segments matched with the non-speech unit.

One or more implementations can optionally include one or more of the following features. The method can include identifying the non-speech unit based on punctuation, grammatical and phrasal structure of the input string. The method can include identifying the non-speech unit based on non-speech codes in the input string. The method can include determining the duration of the non-speech unit. The method can include matching the non-speech unit with non-speech sounds based on duration of the non speech unit. The method can include generating metadata associated with the plurality of audio segments. Generating the metadata can include receiving a voice sample; determining two or more portions of the voice sample having properties; generating a portion of the metadata associated with a first portion of the voice sample to associate a second portion of the voice sample with the first portion of the voice sample; and generating a portion of the metadata associated with the second portion of the voice sample to associate the first portion of the voice sample with the second portion of the voice sample. Generating the metadata can include receiving a voice sample; delimiting a portion of the voice sample in which articulation relationships are substantially self-contained; and generating a portion of the metadata to describe the portion of the voice sample. The method can include identifying a speech unit in a received input string, the speech unit preceding or following the non-speech unit; and matching the non-speech unit with the non-speech sound based on the speech unit. The method can include parsing the speech unit into sub units, at least one sub unit preceding or following the non-speech unit; and matching the non-speech unit with non-speech sounds based on the at least one sub unit. Speech units can be phrases, words, or sub-words in the input string. The method can include limiting synthesizing non-speech units based on a proximity to preceding synthesized pauses. The input string can include ASCII or Unicode characters. The method can include outputting amplified speech comprising the combined audio segments.

In another aspect a method is provided that includes receiving audio segments. The audio segments are parsed into speech units and non-speech units. Properties are defined of or between speech units and non-speech units. The units and the properties are stored.

One or more implementations can optionally include one or more of the following features. The method can include parsing the speech units into sub units; defining properties of or between the sub units; and storing the sub units and properties. The method can include parsing a received input string into speech units and non-speech units; determining properties of or between the speech units and non-speech units if any; matching units to stored units using the properties; and synthesizing the input string including combining the audio segments matched with the speech-units and non-speech units. The method can include defining properties between speech-units and non-speech units.

Particular embodiments of the invention can be implemented to realize one or more of the following advantages. A system that synthesizes speech with non-speech sounds can more accurately mimic patterns of human spoken communication. The resultant synthesized speech sounds more human and less artificial than methods that do not use non-speech sounds. Non-speech sounds add audible information and context to speech. Synthesized speech with non-speech sounds requires less cognitive effort to comprehend and is more likely to be understood when listening conditions are less than ideal. In addition, proper inclusion of non-speech sounds add pleasantness to the experience of listening to the resultant speech, making the task more enjoyable and engaging for the listener. Speech that includes non-speech sounds can lend a sense of personality and approachableness to the device that is speaking.

The details of one or more embodiments of the invention are set forth in the accompanying drawings and the description below. Other features, aspects, and advantages of the invention will be apparent from the description and drawings, and from the claims.

DESCRIPTION OF DRAWINGS

Like reference symbols in the various drawings indicate like elements.

DETAILED DESCRIPTION

Systems, methods, computer program products, and means for including non-speech sounds in text-to-speech synthesis are described. Non-speech sounds are sounds that are not normally captured by the phonetic or any other linguistic description of a spoken language, including: breathing sounds, lip-smacks, tongue flicks, mouth clicks, salivation sounds, sighs and the like. An exemplary system and method is described for mapping text input to speech. Part of the mapping includes the consideration of non-speech sounds that may be appropriate to provide in the audio output.

By way of example a system is described that maps an input stream of text to audio segments that take into account properties of and relationships (including articulation relationships) among units from the text stream. Articulation relationships refer to dependencies between sounds, including non-speech sounds, when spoken by a human. The dependencies can be caused by physical limitations of humans (e.g., limitations of lip movement, vocal cords, human lung capacity, speed of air intake or outtake, etc.) when, for example, speaking without adequate pause, speaking at a fast rate, slurring, and the like. Properties can include those related to pitch, duration, accentuation, spectral characteristics and the like. Properties of a given unit can be used to identify follow on units that are a best match for combination in producing synthesized speech. Hereinafter, properties and relationships that are used to determine units that can be selected from to produce the synthesized speech are referred to in the collective as merely properties.

Figure 1:
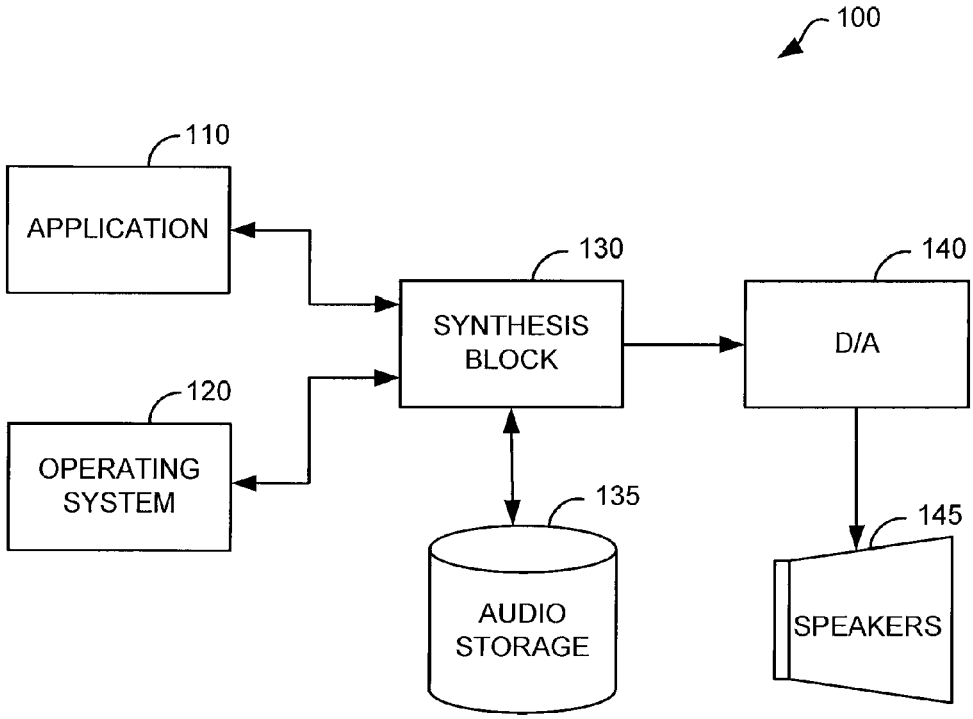
FIG. 1 is a block diagram illustrating a proposed system for text-to-speech synthesis.

FIG. 1 is a block diagram illustrating a system 100 for text-to-speech synthesis that includes non-speech sounds. System 100 includes one or more applications such as application 110, an operating system 120, a synthesis block 130, an audio storage 135, a digital to analog converter (D/A) 140, and one or more speakers 145. The system 100 is merely exemplary. The proposed system can be distributed, in that the input, output and processing of the various streams and data can be performed in several or one location. The input and capture, processing and storage of samples can be separate from the processing of a textual entry. Further, the textual processing can be distributed, where for example the text that is identified or received can be at a device that is separate from the processing device that performs the text to speech processing. Further, the output device that provides the audio can be separate or integrated with the textual processing device. For example, a client server architecture can be provided where the client provides or identifies the textual input, and the server provides the textual processing, returning a processed signal to the client device. The client device can in turn take the processed signal and provide an audio output. Other configurations are possible.

Returning to the exemplary system, application 110 can output a stream of text, having individual text strings, to synthesis block 130 either directly or indirectly through operating system 120. Application 110 can be, for example, a software program such as a word processing application, an Internet browser, a spreadsheet application, a video game, a messaging application (e.g., an e-mail application, an SMS application, an instant messenger, etc.), a multimedia application (e.g., MP3 software), a cellular telephone application, and the like. In one implementation, application 110 displays text strings from various sources (e.g., received as user input, received from a remote user, received from a data file, etc.). A text string can be separated from a continuous text stream through various delimiting techniques described below. Text strings can be included in, for example, a document, a spread sheet, or a message (e.g., e-mail, SMS, instant message, etc.) as a paragraph, a sentence, a phrase, a word, a partial word (i.e., sub-word), phonetic segment and the like. Text strings can include, for example, ASCII or Unicode characters or other representations of words. Text strings can also contain detailed explicit representations of desired phonemes or sub-phoneme articulatory gestures, possibly associated with pitch and/or duration specifications. In one implementation, application 110 includes a portion of synthesis block 130 (e.g., a daemon or capture routine) to identify and initially process text strings for output. In another implementation, application 110 provides a designation for speech output of associated text strings (e.g., enable/disable button).

Operating system 120 can output text strings to synthesis block 130. The text strings can be generated within operating system 120 or be passed from application 110. Operating system 120 can be, for example, a MAC OS X operating system by Apple Computer, Inc. of Cupertino, Calif., a Microsoft Windows operating system, a mobile operating system (e.g., Windows CE or Palm OS), control software embedded within a portable device such as a music player or an in-vehicle navigation system, a cellular telephone control software, and the like. Operating system 120 may generate text strings related to user interactions (e.g., responsive to a user selecting an icon), states of user hardware (e.g., responsive to low battery power or a system shutting down), and the like. In some implementations, a portion or all of synthesis block 130 is integrated within operating system 120. In other implementations, synthesis block 130 interrogates operating system 120 to identify and provide text strings to synthesis block 130.

More generally, a kernel layer (not shown) in operating system 120 can be responsible for general management of system resources and processing time. A core layer can provide a set of interfaces, programs and services for use by the kernel layer. For example, a core layer can manage interactions with application 110. A user interface layer can include APIs (Application Program Interfaces), services and programs to support user applications. For example, a user interface can display a UI (user interface) associated with application 110 and associated text strings in a window or panel. One or more of the layers can provide text streams or text strings to synthesis block 130.

Synthesis block 130 receives text strings or text string information as described. Synthesis block 130 is also in communication with audio segments 135 and D/A converter 140. Synthesis block 130 can be, for example, a software program, a plug-in, a daemon, or a process and include one or more engines for parsing and correlation functions as discussed below in association with FIG. 2. In one implementation, synthesis block 130 can be executed on a dedicated software thread or hardware thread. Synthesis block 130 can be initiated at boot-up, by application, explicitly by a user or by other means. In general, synthesis block 130 provides a combination of audio samples that, when combined together, correspond to text strings. At least some of the audio samples can be selected to include properties or have relationships with other audio samples in order to provide a natural sounding (i.e., less machine-like) combination of audio samples and can include non-speech sounds. Further details in association with synthesis block 130 are given below.

Audio storage 135 can be, for example, a database or other file structure stored in a memory device (e.g., hard drive, flash drive, CD, DVD, RAM, ROM, network storage, audio tape, and the like). Audio storage 135 includes a collection of audio segments and associated metadata (e.g., properties). Individual audio segments can be sound files of various formats such as AIFF (Apple Audio Interchange File Format Audio) by Apple Computer, Inc., MP3, MIDI, WAV, and the like. Sound files can be analog or digital and recorded at frequencies such as 22 khz, 44 khz, or 96 khz and, if digital, at various bit rates. These segments can also be more abstract representations of the acoustic speech signal such as spectral energy peaks, resonances, or even representations of the movements of the mouth, tongue, lips, and other articulators. They can also be indices into codebooks of any of the representations.

The synthesis block can also perform other manipulations of the audio units, such as spectral smoothing, adjustments of pitch or duration, volume normalization, power compression, filtering, and addition of audio effects such as reverberation or echo.

D/A converter 140 receives a combination of audio samples from synthesis block 130. D/A converter 140 produces analog or digital audio information to speaker 145. In one implementation, D/A converter 140 can provide post-processing to a combination of audio samples to improve sound quality. For example, D/A converter 140 can normalize volume levels or pitch rates, perform sound decoding or formatting, and other signal processing.

Speakers 145 can receive audio information from D/A converter 140. The audio information can be pre-amplified (e.g., by a sound card) or amplified internally by speakers 145. In one implementation, speakers 145 produce speech synthesized by synthesis block 130 and cognizable by a human. The speech can include individual units of sound, non-speech sounds or other properties that produce more human like speech.

Figure 2:
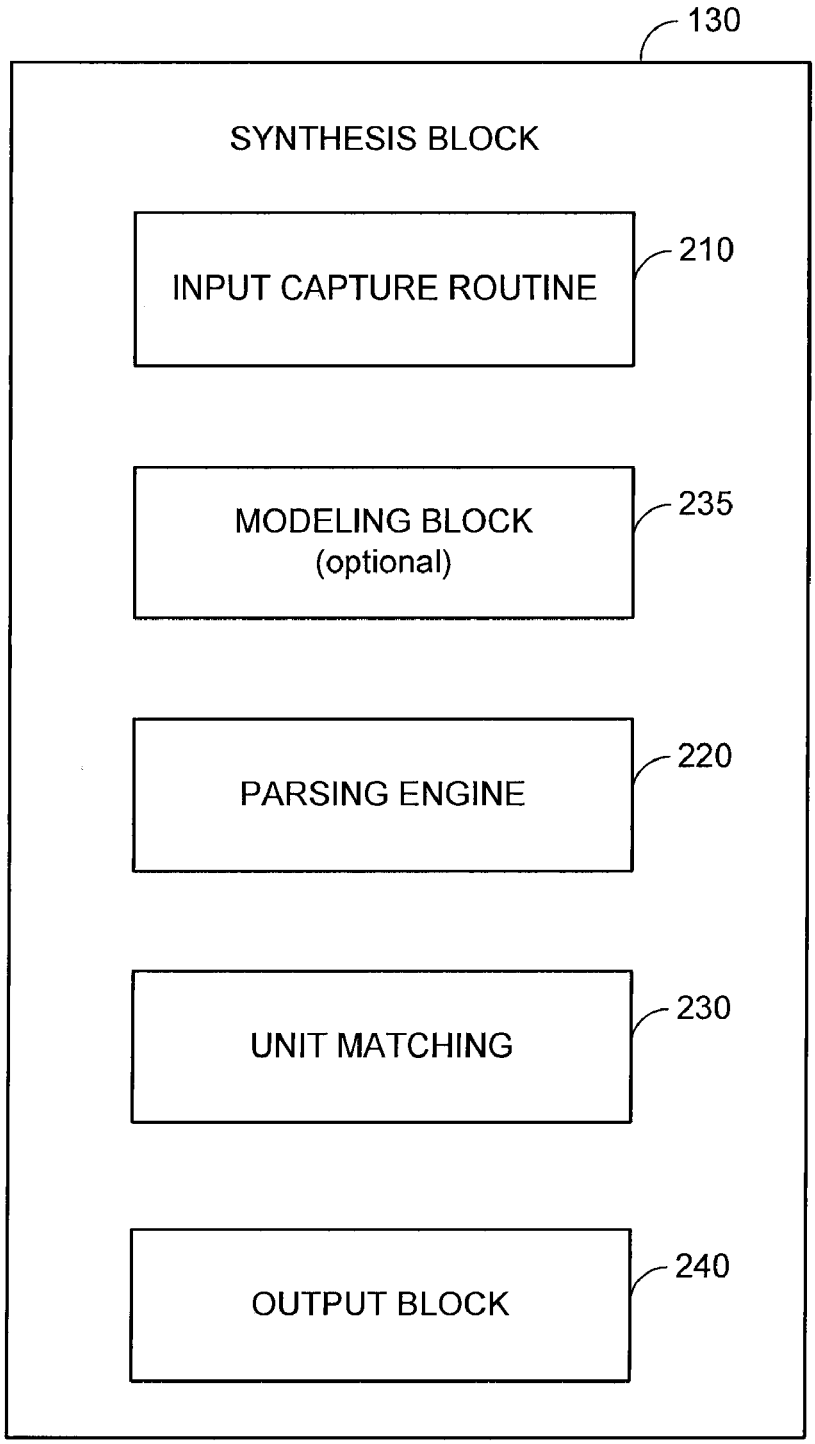
FIG. 2 is a block diagram illustrating a synthesis block of the proposed system of FIG. 1.

FIG. 2 is a more detailed block diagram illustrating synthesis block 130. Synthesis block 130 includes an input capture routine 210, a parsing engine 220, a unit matching engine 230, an optional modeling block 235 and an output block 240.

Input capture routine 210 can be, for example, an application program, a module of an application program, a plug-in, a daemon, a script, or a process. In some implementations, input capture routine 210 is integrated within operating system 120. In some implementations, input capture routine 210 operates as a separate application program or part of a separate application program. In general, input capture routine 210 monitors, captures, identifies and/or receives text strings or other information for generating speech.

Parsing engine 220, in one implementation, delimits a text stream or text string into units. For example, parsing engine 220 can separate a text string into phrase units and non-speech units. Non-speech units specify that a non-speech sound should be synthesized. A non-speech unit can fill, partially fill, or specify a momentary pause having a specific duration. Non-speech units can be identified from punctuation found in the text, including commas, semi-colons, colons, hyphens, periods, ellipses, brackets, paragraph delimiters (e.g., a carriage return followed immediately by a tab) and other punctuation. Non-speech units can also be identified by a grammatical or other analysis of the text even when there is no accompanying punctuation, such as at the boundary between the main topic in a sentence and the subsequent predicate. Alternatively, non-speech codes in the text can denote non-speech units. For example, non-speech codes can be a specific series of characters that indicate that a non-speech unit should be produced (e.g.., <breath, 40>, to denote a breath of 40 milliseconds). In one implementation, phrase units can be further separated into word units, word units into sub-word units, and/or sub-word units into phonetic segment units (e.g., a phoneme, a diphone (phoneme-to-phoneme transition), a triphone (phoneme in context), a syllable or a demrisyllable (half of a syllable) or other similar structure). For the purposes of this disclosure a particular architecture and structure for processing phrase units and other word or sub-word units of text is described. The particular structure should not be viewed as limiting. Other systems for processing phrase, word and sub-word units are possible.

The parsing can separate text into a hierarchy of units where each unit can be relative to and depend on surrounding units. For example, the text "the cat sat on the mattress, happily. The dog came in" can be divided into phrase units 521 and non-speech units 526 (see FIG. 5). Phrase units 521 can be further divided into word units 531 for each word (e.g., phrases divided as necessary into a single word). In addition, word units 531 can be divided into a phonetic segment units 541 or sub-word units (e.g., a single word divided into phonetic segments). Various forms of text string units such as division by tetragrams, trigrams, bigrams, unigrams, phonemes, diphones, and the like, can be implemented to provide a specific hierarchy of units, with the fundamental unit level being a phonetic segment or other sub-word unit. Examples of unit hierarchies are discussed in further detail below. Parsing engine 220 analyzes units to determine properties and relationships and generates information describing the same. The analysis is described in greater detail below.

Unit matching engine 230, in one implementation, matches units from a text string to audio segments at a highest possible level in a unit hierarchy. Other text matching schemes are possible. Matching can be based on the properties of one or more units.

Properties of the preceding or following synthesized audio segment, and the proposed matches can be analyzed to determine a best match. Properties can include those associated with the unit and concatenation costs. Unit costs can include considerations of one or more of pitch, duration, accentuation, and spectral characteristics. Unit cost can also reflect whether the non-speech unit is of an appropriate length. Unit costs measure the similarity or difference from an ideal model. Predictive models can be used to create ideal pitch, duration etc. predictors that can be used to evaluate which unit from a group of similar units (e.g., similar text unit but different audio sample) should be selected. Models are discussed more below in association with modeling block 235.

Concatenation costs can include those associated with articulation relationships such as adjacency between units in samples. Concatenation costs measure how well a unit fits with a neighbor unit. In some implementations, segments can be analyzed grammatically, semantically, phonetically or otherwise to determine a best matching segment from a group of audio segments. Metadata can be stored and used to evaluate best matches. Unit matching engine 230 can search the metadata in audio storage 135 (FIG. 1) for matches. If a match is found, results are produced to output block 240. If match is not found, unit matching engine 230 submits the unmatched unit back to parsing engine 220 for further parsing/processing (e.g., processing at different levels including processing smaller units). When a text string portion cannot be divided any further, an uncorrelated or raw phoneme, other sub-word units or other units lower in the hierarchy, such as phonemes can be produced to output block 240. Further details of one implementation of unit matching engine 230 are described below in association with FIG. 7.

Modeling block 235 produces ideal models that can be used to analyze segments to select a best segment for synthesis. Modeling block 235 can create predictive models that reflect ideal pitch, duration, etc. based on an analysis of the text, prior history of the texts spoken previously in the user interaction, the history of prior user interactions, the communicative purpose of the speech, and prior or learned information about the particular user. Based on the models, a selection of a best matching segment can be made.

Output block 240, in one implementation, combines audio segments including non-speech segments. Output block 240 can receive a copy of a text string received from input capture routine 210 and track matching results from the unit hierarchy to the text string. More specifically, phrase units, non-speech units, word units, sub-word units, and phonetic segments (units), etc., can be associated with different portions of a received text string. The output block 240 produces a combined output for the text string. Output block 240 can produce combined audio segments in batch or on-the-fly.

Figure 3A:
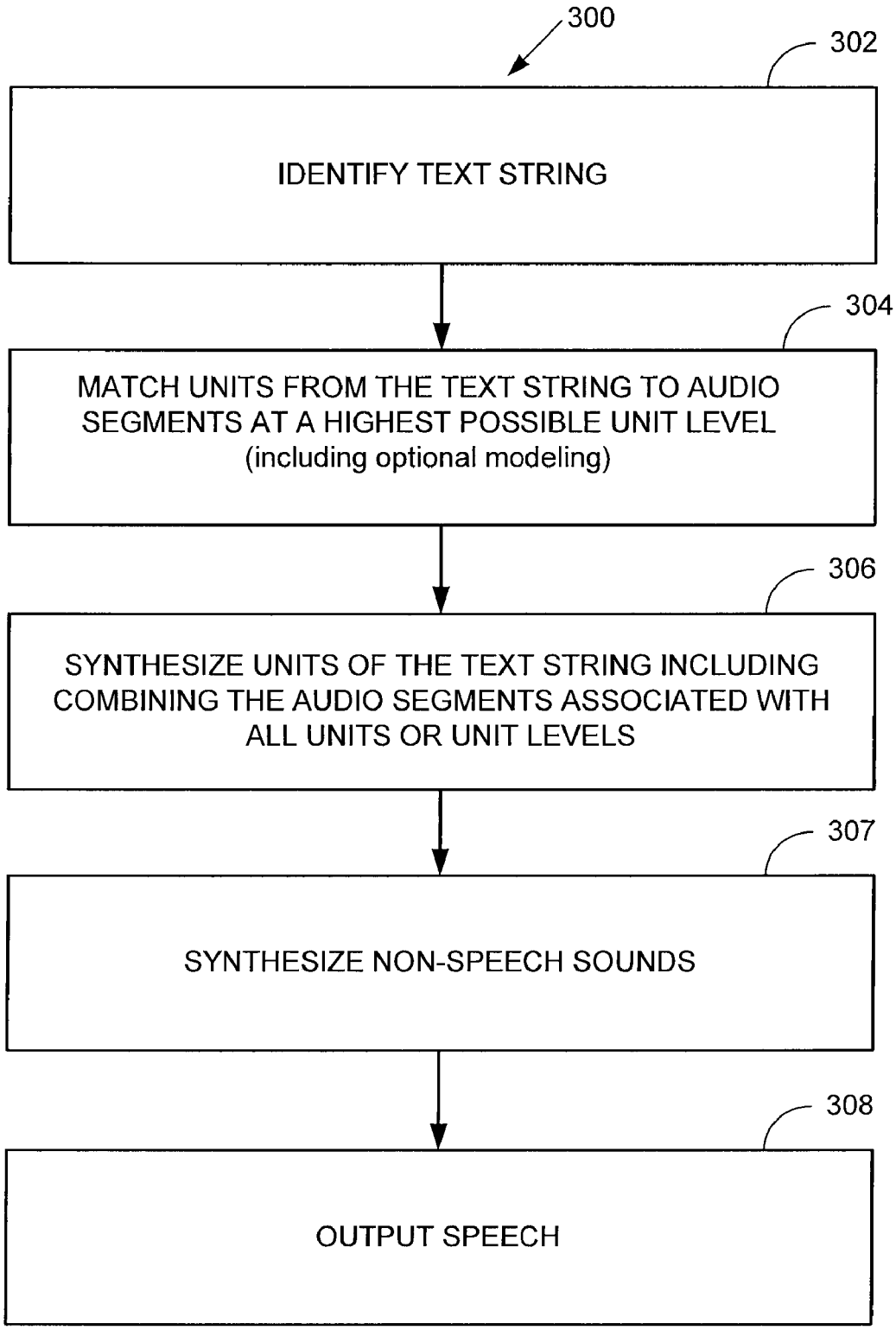
FIG. 3A is a flow diagram illustrating one method for synthesizing text into speech.

FIG. 3A is a flow diagram illustrating a method 300 for synthesizing text to speech. A precursor to the synthesizing process 300 includes the processing and evaluation of training audio samples and storage of such along with attending property information. The precursor process is discussed in greater detail in association with FIG. 4.

A text string is identified 302 for processing (e.g., by input capture routine 210). In response to boot-up of the operating system or launching of an associated application, for example, input text strings from one or more sources can be monitored and identified. The input strings can be, for example, generated by a user, sent to a user, or displayed from a file.

Units from the text string are matched 304 to audio segments, and in one implementation to audio segments at a highest possible unit level. In general, when units are matched at a high level, more articulation relationships will be contained within an audio segment. Higher level articulation relationships can produce more natural sounding speech. In particular, non-speech units from the text are matched with non-speech audio segments (i.e. non-speech units). Matching non-speech units can also, in one implementation, be made at a highest unit level. Matching non-speech units can include evaluating the preceding and following speech units. For example, to synthesize a breath sound that is followed by the word 'cat', a non-speech unit followed by a 'cat' word unit is a better match than a non-speech unit followed by a 'kit' word unit; and both are a better match than a non-speech unit followed by a 'street' word unit. In one implementation, the system also evaluates preceding and following units of non-speech units to determine a non-speech unit that is a best match (e.g., evaluating a series of non speech units preceding a given selection to determine if a breath needs to be inserted or other non-speech unit).

When lower level matches are needed, an attempt is made to parse units and match appropriate articulation relationships at a lower level. More details about one implementation for the parsing and matching processes are discussed below in association with FIG. 7.

Both speech units and non-speech units are identified in accordance with a parsing process. In one implementation, an initial unit level is identified and the text string is parsed to find matching audio segments for each unit. Each unmatched unit then can be further processed. Further processing can include further parsing of the unmatched unit, or a different parsing of the unmatched unit, the entire or a portion of the text string. For example, in one implementation, unmatched units are parsed to a next lower unit level in a hierarchy of unit levels. The process repeats until the lowest unit level is reached or a match is identified. In another implementation, the text string is initially parsed to determine initial units. Unmatched units can be re-parsed. Alternatively, the entire text string can be re-parsed using a different rule(s) and results evaluated. Optionally, modeling can be performed to determine a best matching unit. Modeling is discussed in greater detail below.

Units from the input string are synthesized 306 including combining the audio segments associated with all units or unit levels. Non-speech units from the input string are synthesized including combining the audio segments associated with speech units with the non-speech sounds associated with each matched non-speech unit 307. Combining non-speech sounds can include prefixing particular non-speech sounds with silence so that the duration of the combined sound is sufficient in length. Speech is output 308 at a (e.g., amplified) volume. The combination of audio segments can be post-processed to generate better quality speech. In one implementation, the audio segments can be supplied from recordings under varying conditions or from different audio storage facilities, leading to variations. One example of post-processing is volume normalization. Other post-processing can smooth irregularities between the separate audio segments.

Figure 3B:
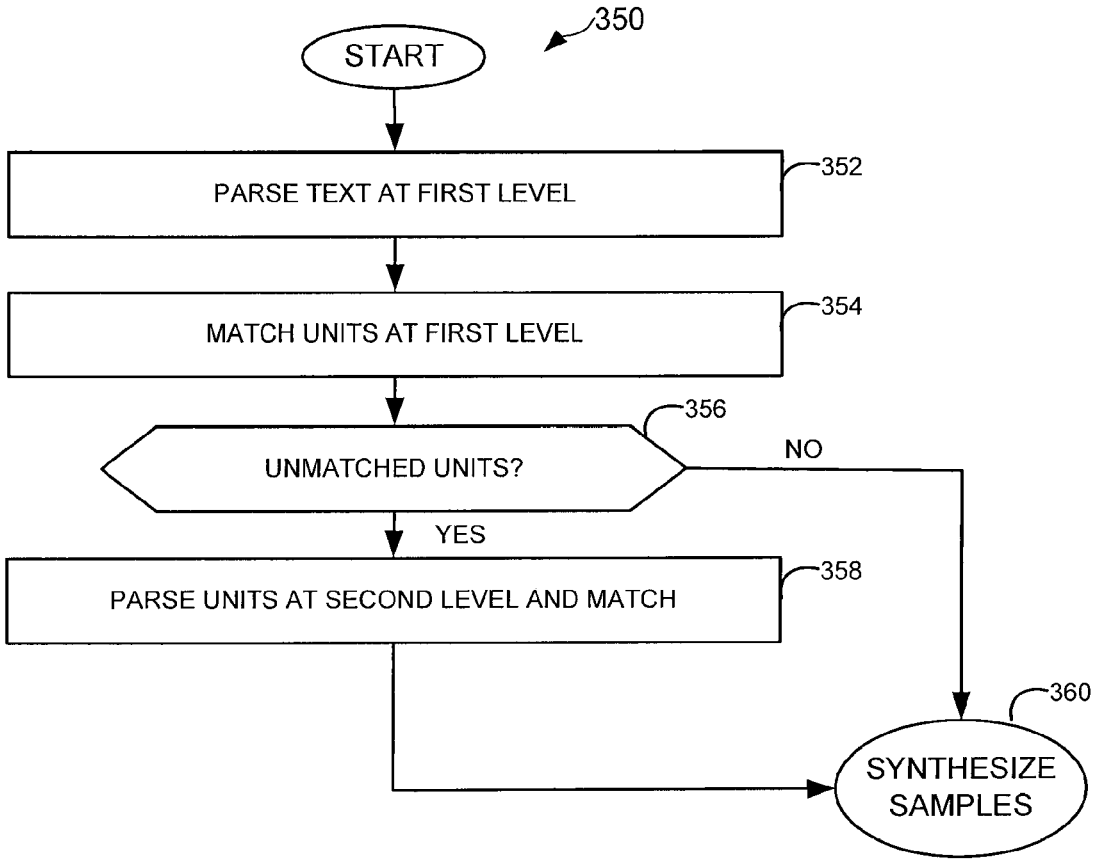
FIG. 3B is a flow diagram illustrating a second method for synthesizing text into speech.

Referring to FIG. 3B another implementation for processing speech is shown. In this method 350, received text is parsed at a first level (352), identifying speech units and non-speech units. The parsing of the text into speech units can be for example at the phrase unit level, word unit, level, sub-word unit level or other level. A match is attempted to be located for each unit (354). If no match is located for a given unit (356), the unmatched unit is parsed again at a second unit level (358). The second unit level can be smaller in size than the first unit level and can be at the word unit level, sub-word unit level, diphone level, phoneme level or other level. In one implementation, the adjacent speech units of unmatched non-speech units are parsed into their second unit level. After parsing, a match is made to a best unit. The matched units are thereafter synthesized to form speech for output (360). Details of a particular matching process at multiple levels are discussed below.

Figure 4:
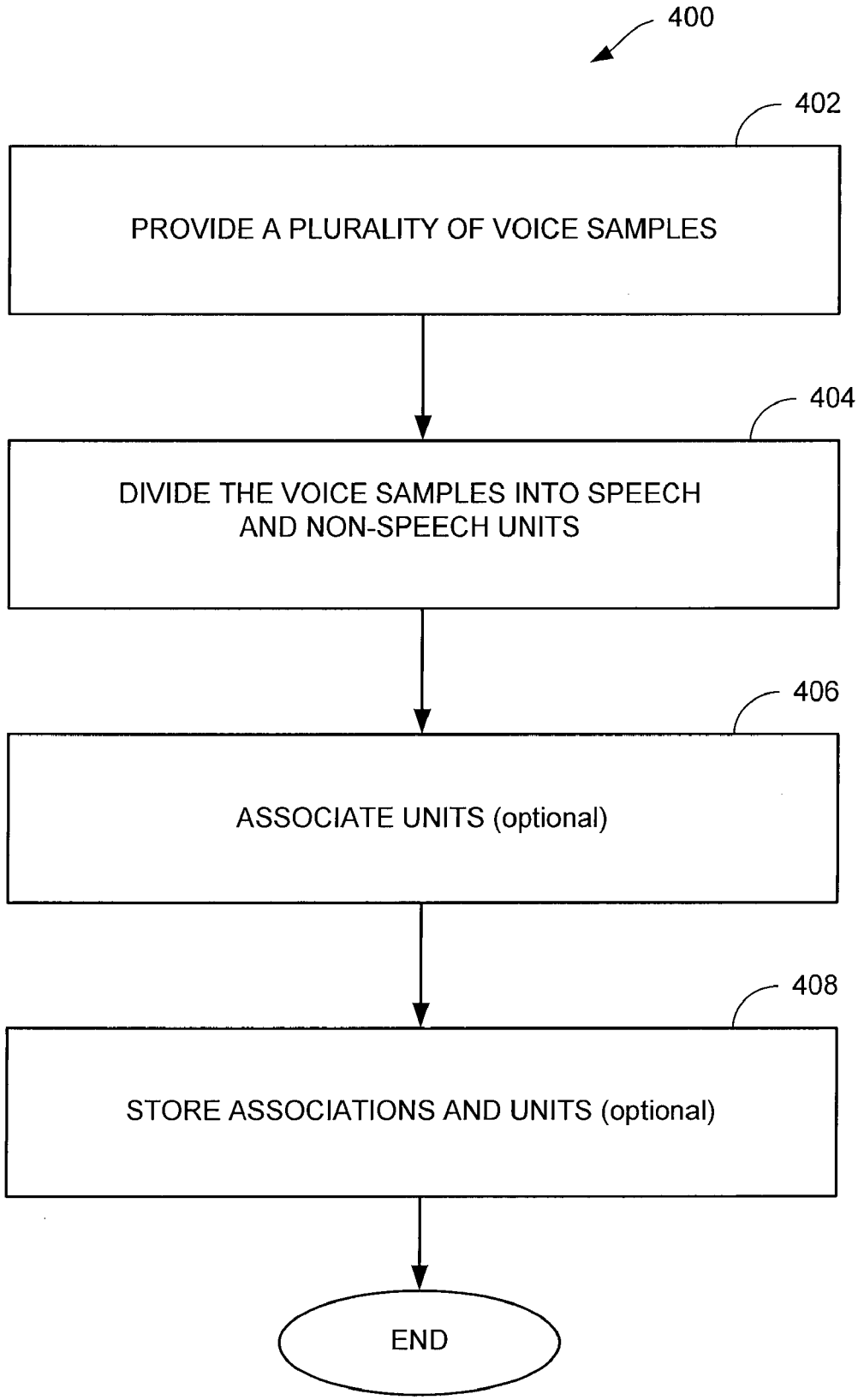
FIG. 4 is a flow diagram illustrating a method for providing a plurality of audio segments having defined properties that can be used in the method shown in FIG. 3.

Prior to matching and synthesis, a corpus of audio samples must be received, evaluated, and stored to facilitate the matching process. The audio samples are required to be divided into unit levels creating audio segments of varying unit sizes. Optional analysis and linking operations can be performed to create additional data (metadata) that can be stored along with the audio segments. FIG. 4 is a flow diagram illustrating one implementation of a method 400 for providing audio segments and attending metadata. Voice samples of speech are provided 402 including associated text. A human can speak into a recording device through a microphone or prerecorded voice samples are provided for training. Optimally one human source is used but output is provided under varied conditions. Different samples can be used to achieve a desired human sounding result. Text corresponding to the voice samples can be provided for accuracy or for more directed training. In another implementation, audio segments can be computer-generated and a voice recognition system or other automatic or supervised pattern-matching system can determine associated text, and pauses and other speech separators from the voice samples.

The voice samples are divided 404 into units. The voice sample can first be divided into a first unit level, for example into phrase units and non-speech units. Phrase units correspond to speech-sounds in the voice sample while non-speech units denote non-speech sounds in the voice sample. Each non-speech unit can be associated with punctuation from the text associated with the sample (e.g., a brief breath sound can may be associated with a comma and a particular longer breath sound may be associated with a period, em dash or paragraph delimiter). The first unit level can be divided into subsequent unit levels in a hierarchy of units. For example, phrase units can be divided into other units (words, subwords, diphones, etc.) as discussed below. In one implementation, the unit levels are not hierarchical, and the division of the voice samples can include division into a plurality of units at a same level (e.g., dividing a voice sample into similar sized units but parsing at a different locations in the sample). In this type of implementation, the voice sample can be parsed a first time to produce a first set of units. Thereafter, the same voice sample can be parsed a second time using a different parsing methodology to produce a second set of units. Both sets of units can be stored including any attending property or relationship data. Other parsing and unit structures are possible. For example, the voice samples can be processed creating units at one or more levels. In one implementation, units are produced at each level. In other implementations, only units at selected levels are produced.

Figure 5:
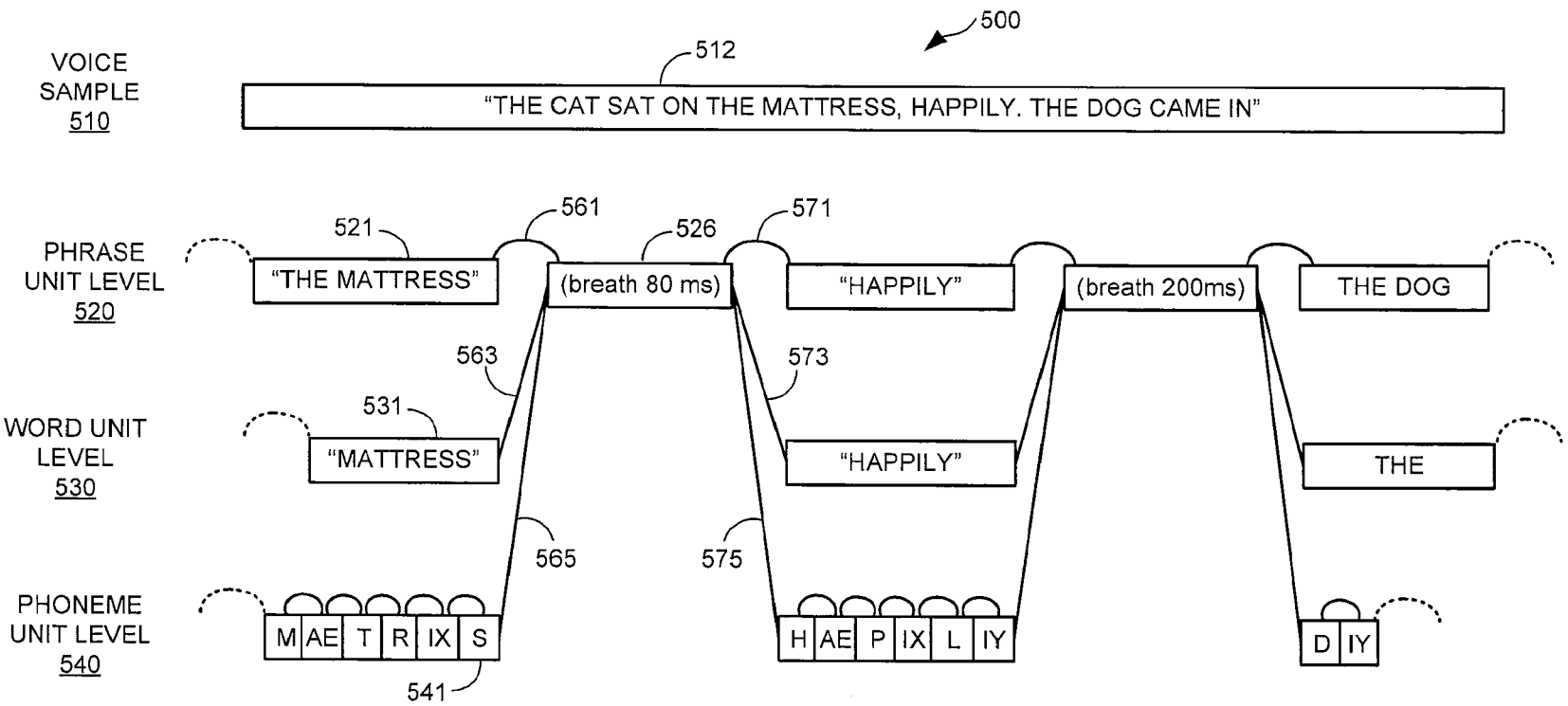
FIG. 5 is a schematic diagram illustrating linked segments.
Figure 6:
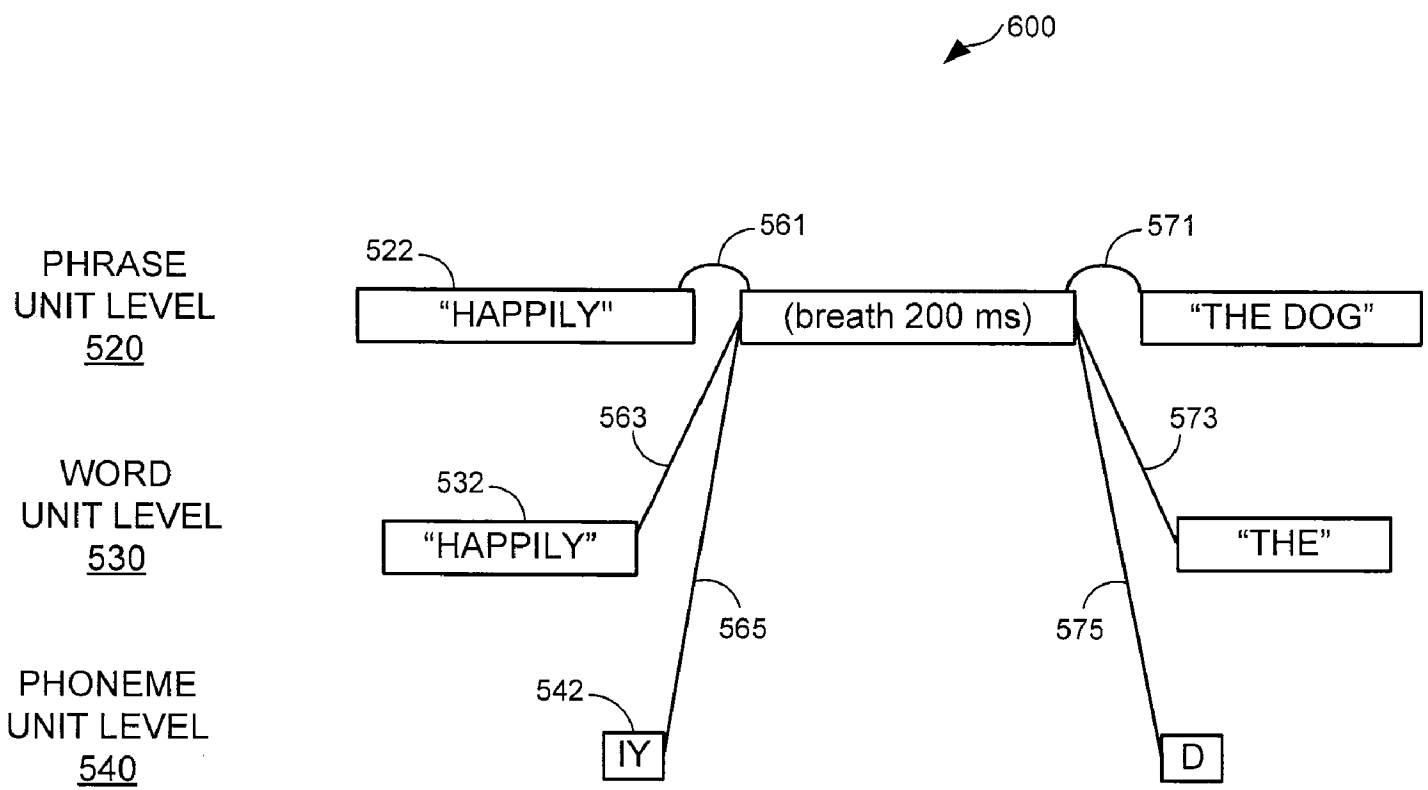
FIG. 6 is a schematic diagram illustrating another example of linked segments.

In some implementations, the units are analyzed for associations and properties 406 and the units and attending data (if available) stored 408. Analysis can include determining associations, such as adjacency, with other units in the same level or other levels. Non-speech units can as well, have associations, such as adjacency. In one implementation separate non-speech units exist at each hierarchy level and can be associated with adjacent units at the same level. In another implementation, non-speech units can be associated with each adjacent unit at more than one (e.g., at all) hierarchical level simultaneously. That is, as is discussed further below, non-speech units can be linked to units at a same or different level (e.g., at a level above, a level below, two levels below, etc.) In one implementation, non-speech units can also have associated properties indicating the aural quality of the unit (e.g., whether it is a intake breath, a sigh, or a breath with a tongue flick, etc) and the non-speech unit's duration. Examples of associations that can be stored are shown in FIGS. 5 and 6. Other analysis can include analysis associated with pitch, duration, accentuation, spectral characteristics, and other features of individual units or groups of units. For example, non-speech units can be analyzed and characterized with respect to type (e.g., breath, sigh, tongue flick, etc.) Analysis is discussed in greater details below. In the end of the sample processing, each unit, including representative text for speech units, associated segment, and metadata (if available) is stored for potential matching.

For example, FIG. 5 is a schematic diagram illustrating a voice sample that is divided into units on different levels. A voice sample 510 includes the phrase 512 "the cat sat on the mattress, happily. The dog came in. The voice sample 510 is divided into phrase units 521 including the text "the cat," "sat," "on the mattress" and "happily" and into non-speech units 526. Each non-speech unit includes a duration that indicates the length of the unit, representing the duration of non-speech captured by the particular non-speech unit. Non-speech units from the same voice sample can be analyzed and characterized by type of non-speech sound, as discussed above. Phrase units 521 are further divided into word units 531 including the text "the", "mattress" and others. The last unit level of this example is a phonetic segment unit level 540 that includes units 541 which represent word enunciations on an atomic level. For example, the sample word "the" consists of the phonemes "D" and "AX" (to rhyme with "thuh", as in the first syllable of "about"). However, in the same voice sample another instance of the sample word "the" can consist of the phonemes "D" and "IY" (to rhyme with "thee"). The difference stems from a stronger emphasis of the word "the" in speech when beginning a sentence or after a pause. These differences can be captured in metadata (e.g., location or articulation relationship data) associated with the different voice samples (and be used to determine which segment to select from plural available similar segments).

As discussed in FIG. 4, associations between units can be captured in metadata and saved with the individual audio segments. The associations can include adjacency data between and across unit levels. In FIG. 5, three levels of unit associations are shown (phrase unit level 520, word unit level 530 and phonetic segment unit level 540). In FIG. 5, on a phrase unit level 520, association 561 link preceding phrase units 521 with non-speech units 526. Similarly, on word unit level 530 and a phonetic segment unit level 540, associations 563 link preceding word units 531 with non-speech units and preceding phonetic segment units 541 with non-speech units, respectively. Other levels are also possible, such as morphemes or syllables between words and phonemes, and units lower than phonemes such as articulatory gestures or pitch periods. Each non-speech unit in this example is also linked to all adjacent units at each level. Also, associations 571, 573, 575 link non-speech units with following phrase, word and phoneme units, respectively. In FIG. 6, the non-speech unit 526 is associated with preceding and following adjacent units at each hierarchy level.

As described above, associations can be stored as metadata corresponding to units. In one implementation, each phrase unit, word unit, sub-word unit, phonetic segment unit, etc., can be saved as a separate audio segment. Additionally, links between units can be saved as metadata. The metadata can further indicate whether a link is forward or backward and whether a link is between peer units or between unit levels.

Figure 7:
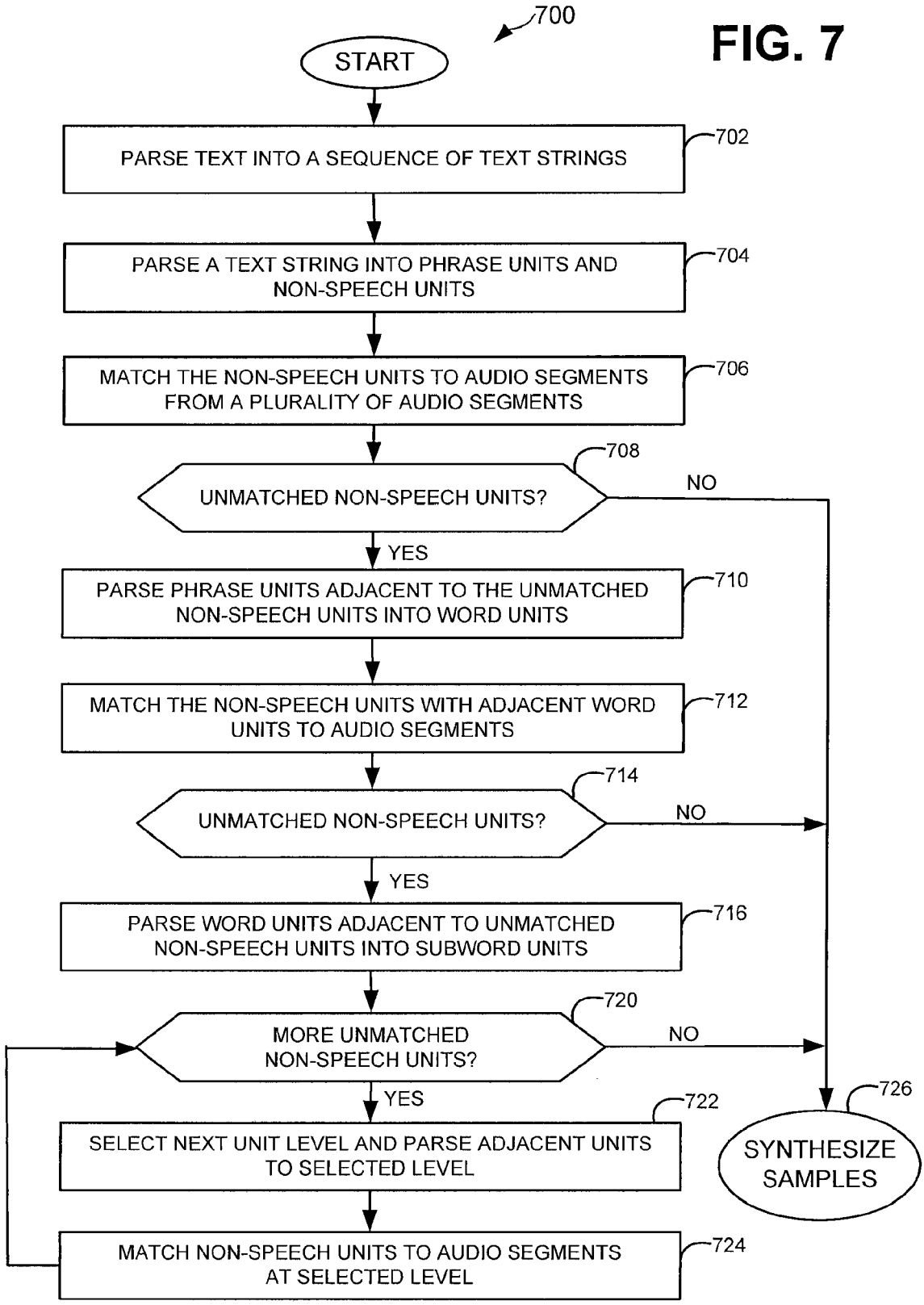
FIG. 7 is a flow diagram illustrating a method for matching units from a stream of text to audio segments at a highest possible unit level.

As described above, matching can include matching portions of text defined by units with segments of stored audio. The text being analyzed can be divided into units and matching routines performed. One specific matching routine includes matching to a highest level in a hierarchy of unit levels. FIG. 7 is a flow diagram illustrating a method 700 for matching non-speech units from a text string to non-speech audio segments at a highest possible unit level. A text stream (e.g., continuous text stream) is parsed 702 into a sequence of text strings for processing. In one implementation, a text stream can be divided using grammatical delimiters (e.g., periods, and semi-colons) and other document delimiters (e.g., page breaks, paragraph symbols, numbers, outline headers, and bullet points) so as to divide a continuous or long text stream into portions for processing. In one implementation, the portions for processing represent sentences of the received text. Alternatively, the portions of text for processing can represent the entire text including multiple pages, paragraphs and sentences.

Each text string is parsed 704 into phrase units and non-speech units (e.g., by parsing engine 220). In one implementation, a text string itself can comprise a phrase unit and one or more non-speech units. In other implementations, the text string can be divided, for example, into a predetermined number of words, into recognizable phrases, non-speech units (e.g., pauses), word pairs, and the like. The non-speech units are matched 706 to audio segments from a plurality of audio segments (e.g., by unit matching engine 230). To do so, an index of audio segments (e.g., stored in audio storage 135) can be accessed. In one implementation, metadata describing the audio segments is searched. The metadata can provide information about articulation relationships, properties or other data of a non-speech unit or phrase unit as described above. For example, the metadata can describe links between audio segments as peer level associations or inter-level associations (e.g., separated by one level, two levels, or more). For the most natural sounding speech, a highest level match (e.g., phrase unit level in this example) is preferable.

More particularly, when a non-speech unit in the text string is identified an attempt is made to match it with a stored non-speech unit of equal or lesser duration and, ideally, with matching adjacent high-level units (e.g., units at the phrase unit level). In another implementation a non-speech sound that is longer than the non-speech unit is allowed if the duration of the sound does not exceed some criterion value and if the unit is particularly desirable (e.g., if, in the original recording, the non-speech sound unit was preceded and followed by the same words as are needed in the text string). If no match is determined because no non-speech unit is available with matching high-level units, then the units adjacent to the unmatched non-speech unit can be further parsed to create other lower-level units. Using the lower-level adjacent units another search for a match is attempted. The process continues until a match occurs or no further parsing of adjacent units is possible (i.e., parsing to the lowest possible level has occurred or no other parsing definitions have been provided). If a match is found, but the located non-speech unit has lesser duration than the ideal non-speech unit being matched, the located non-speech unit can be appended (e.g., prefixed) with silence to make up the difference in duration between the located non-speech unit and the desired non-speech unit. If no matching non-speech unit is found, then the unmatched non-speech unit can, in one implementation, be replaced by silence in the final syntheses for the duration specified by the non-speech unit. Subsequent non-speech units in the text string are processed at the first unit level (e.g., phrase unit level) in a similar manner.

Matching can include the evaluation of a plurality of similar (i.e., same text or same non-speech) units having different audio segments (e.g., different accentuation, different duration, different pitch, etc.). Matching can include evaluating data associated with a candidate unit (e.g., metadata) and evaluation of preceding and following units that have been matched (e.g., evaluating the previous matched unit to determine what if any relationships or properties are associated with this unit). Matching is discussed in more detail below.

Returning to the particular implementation shown in FIG. 7, if there are unmatched non-speech units 708, the phrase units adjacent to unmatched non-speech units are parsed 710 into, for example, word units. For example, phrase units that are word pairs can be separated into separate words. The matching is attempted among non-speech units and adjacent word units 712.

If there are unmatched non-speech units 714, the word units adjacent to the unmatched non-speech units are parsed 716 into, for example, sub-word units. For example, word units can be parsed into words, having suffixes or prefixes. If no unmatched non-speech units remain 720 (at this or any level), the matching process ends and synthesis of the text samples can be initiated (726). Otherwise the process can continue at a next unit level 722. At each unit level, a check is made to determine if a match has been located 724. If no match is found, the process continues including parsing adjacent units of unmatched non-speech units to a new lower level in the hierarchy until a final unit level is reached 720. If unmatched units remain after all other levels have been checked, then silence can be output for the duration of the unmatched non-speech unit.

In one implementation, a check is added in the process after matches have been determined (not shown). The check can allow for further refinement in accordance with separate rules. For example, even though a match is located at one unit level, it may be desirable to check to at a next or lower unit level for a match. The additional check can include user input to allow for selection from among possible match levels. Other check options are possible.

Optionally, heuristic rules can also govern the matching of non-speech. These rules are particularly useful for simulating realistic breathing patterns. For example, a rule can specify that a non-speech unit should not be matched if a non-speech unit was replaced by a similar non-speech unit within five words of the current non-speech unit in the text string. Another rule can specify that a non-speech unit that precedes a sentence should only be matched if the sentence is longer than eight words, unless no non-speech units have been matched in the last eight words (i.e., after successive of short sentences). A rule can specify that non-speech units only be matched if the non-speech unit precedes a phrase unit, but never if the non-speech unit precedes an utterance (e.g., a one or two word phrase unit). Yet another rule can specify that non-speech units in the middle of a sentence only be matched if the phrase unit following the non-speech unit is more than six words. The particular threshold of words can be tuned to the desired speaking style. For example, when synthesizing speech with faster speaking rates (e.g., for use in screen readers for users with limited vision) the numbers might be larger. Other rules are possible.

Figure 8:
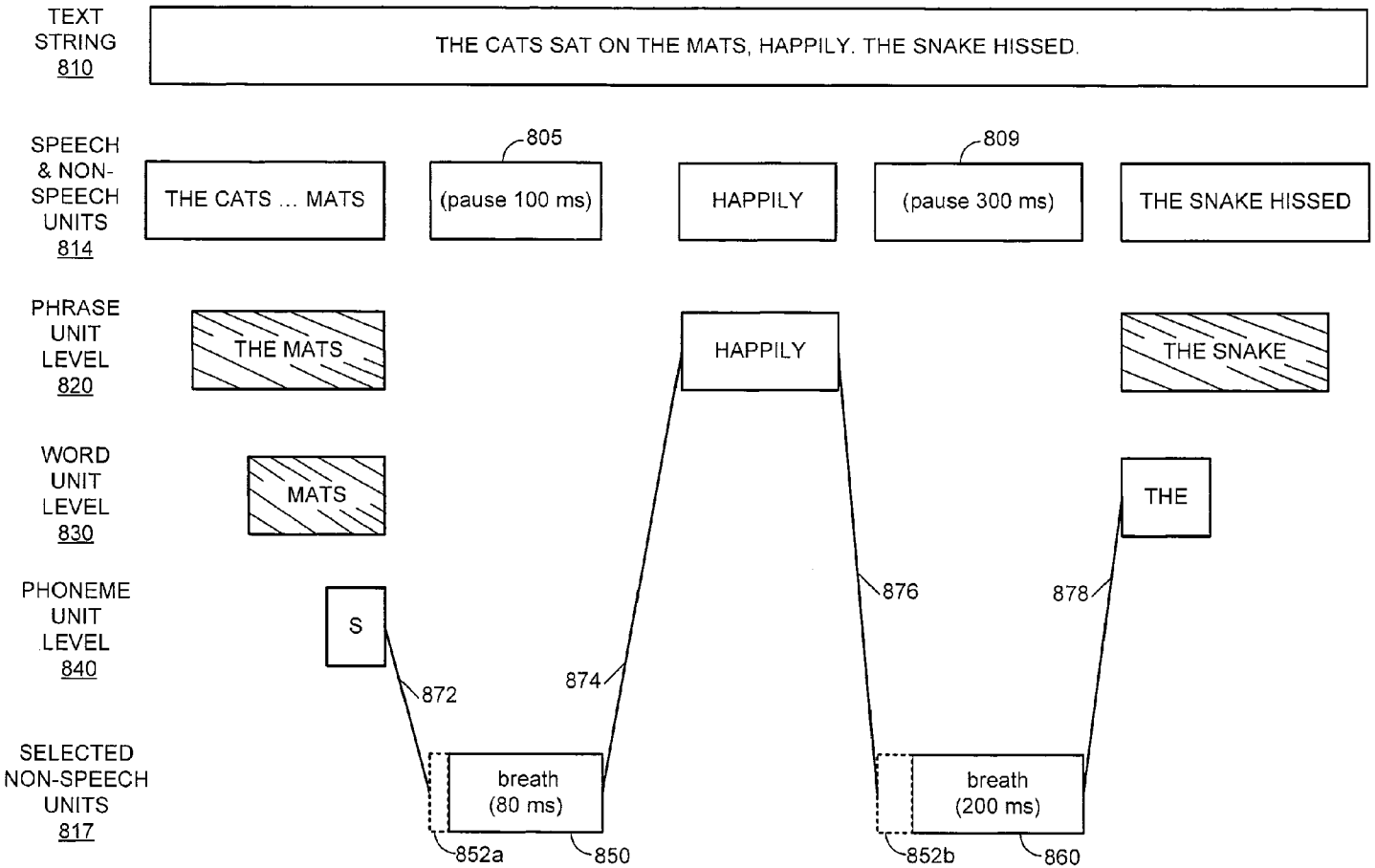
FIG. 8 is a schematic diagram illustrating linked segments.

FIG. 8 is a schematic diagram illustrating an example of a process matching non-speech units. The text string 810 that is to be processed is "The cats sat on the mats, happily. The snake hissed." For the purposes of this example, the only searchable/matchable units that are available are those associated with the single training sample "the cat sat on the mattress, happily. The dog came in" described previously, and in particular the two non-speech units of substantially 80 and 200 milliseconds provided therein. Furthermore, the focus of this example is to illustrate how non-speech sounds are synthesized, while ignoring the synthesis of the remaining speech sounds. This example assumes that the text string 810 has been parsed using grammatical delimiters, such as periods and commas, to determine the location and duration of non-speech elements. The identified non-speech units for text string 810 include non-speech units 805 and 809, which are substantially 100 milliseconds and 300 milliseconds in length, respectively. At the phrase unit level 820, non-speech units are matched by considering their adjacent phrase units. The selected non-speech sounds are shown at level 817.

The first non-speech unit 805 is a match for the 80 ms non-speech unit 850 based on the following "happily" phrase unit, but the preceding "the mats" phrase unit does not match any known non-speech unit. A search for non-speech units with matching adjacent word units is made at, for example a next unit level, the word unit level 830. Again, the preceding "mats" word unit does not match the preceding word units of any known non-speech unit. A search for non-speech units with matching adjacent phonemes is made at the phoneme level 840. At the phoneme level, the "S" phoneme, derived from "mats", provides a match. The matching non-speech unit 850 is selected for synthesis of the non-speech unit 805. The links 872 and 874 denote the association between the non-speech unit and its adjacent units as determined during voice sample processing, as described in reference to FIG. 5.

The second non-speech unit 809 is a match with the 200 ms non-speech unit 860 based on the preceding "happily" phrase unit, however the following phrase unit "the snake" does not match the following phrase unit of any known non-speech unit at the initial level (e.g., the phrase level). A search for non-speech units with adjacent word units is made at the next level, for example the word unit level 830. At the word level, the "the" word derived from "the snake" matches "the" following the non-speech unit 860. Accordingly, the matching non-speech unit 860 is selected for synthesis of the matched non-speech unit 809. The links 876 and 878 denote the association between the non-speech unit and its adjacent units as determined during voice sample processing, as described in reference to FIG. 5.

Both non-speech units in the above examples are shorter than the duration specified by the non-speech units that they synthesize. In one implementation, a matching non-speech unit should be as close to, but not longer than the non-speech unit it replaces (i.e., synthesizes). In another implementation, the duration of matching non-speech unit must be greater than a minimum proportion of the desired duration (e.g., a matching speech-unit must have a duration greater than 75% of desired duration). In the example illustrated in FIG. 8, although a longer non-speech unit with similar adjacent units would be preferable, a short non-speech unit is preferable to none at all. To compensate for the difference, silence is synthesized 852 to, for example, the beginning of each matching non-speech unit that is shorter than desired. In the example above, twenty milliseconds of silence 852*a* is prefixed to the 80 ms non-speech unit 850, while 100 ms of silence 852*b* is prefixed to the 200 ms non-speech unit 860.

Matching and Properties

As described above, properties of units can be stored for matching purposes. Examples of properties include adjacency, pitch contour, accentuation, spectral characteristics, span (e.g., whether the instance spans a silence, a glottal stop, or a word boundary), grammatical context, position (e.g., of word in a sentence), isolation properties (e.g., whether a word can be used in isolation or needs always to be preceded or followed by another word), duration, compound property (e.g., whether the word is part of a compound, other individual unit properties or other properties . After parsing, evaluation of the unit, and adjoining units in the text string, can be performed to develop additional data (e.g., metadata). As described above, the additional data can allow for better matches and produce better end results. Alternatively, only units (e.g., text, non-speech units and audio segments alone) without additional data can be stored.

A non-speech unit can also be marked with properties such as whether the unit contains a breath intake, lip or tongue click, nasal squeak, snort, cough, throat-clearing, creaky voice, or a sigh. Such properties can be used during selection depending on a text analysis, or by explicit annotation (e.g., in the input text) by the user.

In one implementation, three unit levels are created including phrases, words and diphones. In this implementation, for each diphone unit one or more of the following additional data is stored for matching purposes:

- The pitch contour of the instance, i.e., whether pitch rises, falls, has bumps, etc.
- The accentuation of the phoneme that the instance overlaps, whether it is accentuated or not.
- The spectral characteristics of the border of the instance, i.e. what acoustic contexts it is most likely to fit in.
- Whether the instance spans a silence, a glottal stop, or a word boundary.
- The adjacent instances, which allows the system to know what we want to know about the phonetic context of the instance.

In this implementation, for each word unit, one or more of the following additional data is stored for matching purposes:

- The grammatical (console the child vs. console window) and semantic (bass fishing vs. bass playing) properties of the word.
- The pitch contour of the instance, i.e., whether pitch rises, falls, has bumps, etc.
- The accentuation of the instance, whether it is accentuated or not, and further details of the type and prominence of any associated pitch accent.
- The position of the word in the phrase it was originally articulated (beginning, middle, end, before a comma, etc.).
- Whether the word can be used in an arbitrary context (or needs to always precede or follow its immediate neighbor).
- Whether the word was part of a compound, i.e. the "fire" in "firefighter".

In this implementation, for each phrase unit, adjacency data can be stored for matching purposes. The adjacency data can be at a same or different unit level.

The invention and all of the functional operations described herein can be implemented in digital electronic circuitry, or in computer hardware, firmware, software, or in combinations of them. The invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a device having a display, e.g., a CRT (cathode ray tube) or LCD (liquid crystal display) monitor, for displaying information to the user and an input device, e.g., a keyboard, a mouse, a trackball, and the like by which the user can provide input to the computer. Other kinds of devices can be used to provide for interaction with a user as well; for example, feedback provided to the user can be any form of sensory feedback, e.g., visual feedback, auditory feedback provided by speakers associated with a device, externally attached speakers, headphones, and the like, or tactile feedback; and input from the user can be received in any form, including acoustic, speech, or tactile input.

The invention can be implemented in, e.g., a computing system, a handheld device, a telephone, a consumer appliance, a multimedia player, an in-vehicle navigation and information system or any other processor-based device. A computing system implementation can include a back-end component, e.g., as a data server, or that includes a middleware component, e.g., an application server, or that includes a front-end component, e.g., a client computer having a graphical user interface or a Web browser through which a user can interact with an implementation of the invention, or any combination of such back-end, middleware, or front-end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

A number of implementations have been described. Nevertheless, it will be understood that various modifications may be made. For example, though three or four specific unit levels were described above in the context of the synthesis process, other numbers and kinds of levels can be used. Furthermore, though the process describes adding non-speech sounds during speech synthesis, non-speech sounds can alternatively be used to augment an existing synthesized speech segment. Such an implementation can fill silent pauses in an existing synthesized speech segment with non-speech sounds. The augmentation of silences in an existing speech segment can be based on text associated with the segment or can be based on aural characteristics of the segment itself (e.g., duration since last pause, or the pitch, volume, quality or pattern of sound immediately preceding or following the pause). Finally, the synthesis of non-speech sounds can include emotive utterances that are not usually associated with formal speech patterns, such as laughing, crying, contemplation (e.g. 'hmmm'), taunting (e.g. a raspberry), etc. Accordingly, other implementations are within the scope of the following claims.

The above treatment of non-speech sounds is described within the framework of concatenative synthesis based on a corpus of audio recordings. Alternative parametric forms of speech synthesis, such as formation synthesis or articulatory synthesis, could equally well support this invention by synthesizing the acoustic or articulatory correlates of the non-speech sounds rather than by inserting fragments of audio recordings.

What is claimed is:

1. A method, comprising:

parsing text into speech units and non-speech units at a first speech unit level;

attempting to match a non-speech unit with a first audio segment;

determining that there are unmatched non-speech units at the first speech unit level;

parsing speech units adjacent to unmatched non-speech units into speech units at a second speech unit level;

attempting to match an unmatched non-speech unit having an adjacent speech unit at the second speech unit level with a second audio segment; and creating a portion of speech by synthesizing a portion of the text string containing speech units into speech and augmenting the portion of synthesized speech with the first or second audio segment.

2. The method of claim 1, where a non-speech sound includes the sound of one or more of:

inhalation;

exhalation;

mouth clicks;

lip smacks;

tongue flicks; and salivation.

3. A computer-readable, non-transitory storage medium having instructions stored thereon, which, when executed by a processor, causes the processor to perform operations, comprising:

parsing text into speech units and non-speech units at a first speech unit level;

attempting to match a non-speech unit with a first audio segment;

determining that there are unmatched non-speech units at the first speech unit level;

parsing speech units adjacent to unmatched non-speech units into speech units at a second speech unit level;

attempting to match an unmatched non-speech unit having an adjacent speech unit at the second speech unit level with a second audio segment; and creating a portion of speech by synthesizing a portion of the text string containing speech units into speech; and augmenting the portion of synthesized speech with the first or second audio segment.

4. A system comprising:

a processor;

memory having instructions stored thereon, which, when executed by the processor, cause the processor to perform operations, comprising:

parsing text into speech units and non-speech units at a first speech unit level;

attempting to match a non-speech unit with a first audio segment;

determining that there are unmatched non-speech units at the first speech unit level;

parsing speech units adjacent to unmatched non-speech units into speech units at a second speech unit level;

attempting to match an unmatched non-speech unit having an adjacent speech unit at the second speech unit level with a second audio segment; and creating a portion of speech by synthesizing a portion of the text string containing speech units into speech and augmenting the portion of synthesized speech with the first or second audio segment.

5. A method comprising:

parsing a text string into phrase units and non-speech units;

attempting to match a non-speech unit to a first audio segment;

determining that there are unmatched non-speech units;

parsing phrase units adjacent to unmatched non-speech units into word units;

attempting to match an unmatched non-speech unit having an adjacent word unit to a second audio segment; and creating a portion of speech by synthesizing a portion of the text string containing speech units into speech and augmenting the portion of synthesized speech with the first or second audio segment.

6. The method of claim 5, further comprising:

after attempting to match an unmatched non-speech unit having an adjacent word unit to a second audio segment, determining that there are unmatched non-speech units;

parsing word units adjacent to unmatched non-speech units into subword units;

attempting to match an unmatched non-speech unit having an adjacent subword unit to a third audio segment; and augmenting the portion of synthesized speech with the third audio segment.

7. The method of claim 5, where a non-speech sound includes the sound of one or more of:

inhalation;

exhalation;

mouth clicks;

lip smacks;

tongue flicks; and salivation.

8. A computer-readable, non-transitory storage medium having instructions stored thereon, which, when executed by a processor, causes the processor to perform operations, comprising:

parsing a text string into phrase units and non-speech units;

attempting to match a non-speech unit to a first audio segment;

determining that there are unmatched non-speech units;

parsing phrase units adjacent to unmatched non-speech units into word units;

attempting to match an unmatched non-speech unit having an adjacent word unit to a second audio segment; and creating a portion of speech by synthesizing a portion of the text string containing speech units into speech and augmenting the portion of synthesized speech with the first or second audio segment.

9. The computer-readable, non-transitory storage medium of claim 8, wherein the instructions include instructions which cause the processor to perform operations, comprising:

after attempting to match an unmatched non-speech unit having an adjacent word unit to a second audio segment, determining that there are unmatched non-speech units;

parsing word units adjacent to unmatched non-speech units into subword units;

attempting to match an unmatched non-speech unit having an adjacent subword unit to a third audio segment; and augmenting the portion of synthesized speech with the third audio segment.

10. The computer-readable, non-transitory storage medium of claim 8, where a non-speech sound includes the sound of one or more of:

inhalation;

exhalation;

mouth clicks;

lip smacks;

tongue flicks; and salivation.

11. A system comprising:

a processor;

memory having instructions stored thereon, which, when executed by the processor, cause the processor to perform operations, comprising:

parsing a text string into phrase units and non-speech units;

attempting to match a non-speech unit to a first audio segment;

determining that there are unmatched non-speech units;

parsing phrase units adjacent to unmatched non-speech units into word units;

attempting to match an unmatched non-speech unit having an adjacent word unit to a second audio segment; and creating a portion of speech by synthesizing a portion of the text string containing speech units into speech and augmenting the portion of synthesized speech with the first or second audio segment.

12. The system of claim 11, wherein the instructions include instructions which cause the processor to perform operations, comprising:

after attempting to match an unmatched non-speech unit having an adjacent word unit to a second audio segment, determining that there are unmatched non-speech units;

parsing word units adjacent to unmatched non-speech units into subword units;

attempting to match an unmatched non-speech unit having an adjacent subword unit to a third audio segment; and augmenting the portion of synthesized speech with the third audio segment.

13. The system of claim 11, where a non-speech sound includes the sound of one or more of:

inhalation;
exhalation;
mouth clicks;
lip smacks;
tongue flicks; and
salivation.

* * * * *